US010935276B2

(12) United States Patent
Michalski

(10) Patent No.: US 10,935,276 B2
(45) Date of Patent: Mar. 2, 2021

(54) AIR MIXING DEVICE

(71) Applicant: Steven Michalski, 4 Willow Way, NY (US)

(72) Inventor: Steven Michalski, 4 Willow Way, NY (US)

( * ) Notice: Subject to any disclaimer, the term of this patent is extended or adjusted under 35 U.S.C. 154(b) by 419 days.

(21) Appl. No.: 14/887,392

(22) Filed: Oct. 20, 2015

(65) Prior Publication Data

US 2017/0108239 A1 Apr. 20, 2017

(51) Int. Cl.

| | |
|---|---|
| ***F24F 13/04*** | (2006.01) |
| ***F24F 11/72*** | (2018.01) |
| ***F24F 13/02*** | (2006.01) |
| ***F24F 11/00*** | (2018.01) |
| ***F24F 7/08*** | (2006.01) |

(52) U.S. Cl.

CPC ..... *F24F 13/04* (2013.01); *F24F 11/72* (2018.01); *F24F 13/0218* (2013.01); *F24F 13/0227* (2013.01); *F24F 7/08* (2013.01); *F24F 11/0001* (2013.01); *F24F 2011/0002* (2013.01); *F24F 2221/38* (2013.01)

(58) Field of Classification Search

CPC ..... F24F 7/10; F24F 11/022; F24F 13/0218; F24F 13/0227; F24F 13/04; F24F 13/14; F24F 13/28; F24F 13/30

USPC ..... 454/205

See application file for complete search history.

(56) References Cited

U.S. PATENT DOCUMENTS

| | | | | |
|---|---|---|---|---|
| 1,788,556 A | | 1/1931 | Wood et al. | |
| 2,010,809 A | | 8/1935 | Braine | |
| 2,218,330 A | | 10/1940 | Eliason | |
| 2,296,635 A | | 9/1942 | Foehrenbach et al. | |
| 3,230,556 A | * | 1/1966 | Shippee | A47C 21/044 392/379 |
| 4,330,082 A | | 5/1982 | Wilson | |
| 5,080,005 A | | 1/1992 | Kolt | |
| 5,584,286 A | | 12/1996 | Kippax | |

(Continued)

FOREIGN PATENT DOCUMENTS

| | | |
|---|---|---|
| JP | 2912340020 | 11/2002 |
| JP | 2005003321 | 6/2005 |

(Continued)

OTHER PUBLICATIONS

Ventilation for Acceptable Indoor Air Quality—ASHRAE Standard ANSI/ASHRAE Standard 62.1-2010.

(Continued)

*Primary Examiner* — Steven B McAllister
*Assistant Examiner* — Allen R Schult
(74) *Attorney, Agent, or Firm* — Lawrence D. Cutter, Esq.

(57) ABSTRACT

A portable enclosure is configured to mix room air with a controlled amount of exterior air via one or more flexible conduits disposed between the enclosure and an exterior window. At least one flexible conduit is connected to a barrier structure which is designed for sealable placement within the window. One or more mixing dampers are employed to control the amount of exterior air supplied to the enclosure. An air moving device delivers exterior air in controlled amounts to the enclosure which is designed to be movable so that a more desirable (fresher, cooler, and more contaminant free) stream of air is deliverable to the personal space of an occupant to satisfy ventilation and temperature requirements.

24 Claims, 4 Drawing Sheets

(56) References Cited

U.S. PATENT DOCUMENTS

| | | | | |
|---|---|---|---|---|
| 5,606,865 | A | 3/1997 | Caron | |
| 5,702,296 | A * | 12/1997 | Grano | F24F 7/013 165/54 |
| 5,915,620 | A * | 6/1999 | Doss | A01K 1/0076 237/46 |
| 6,014,949 | A | 1/2000 | Ball | |
| 6,402,613 | B1 | 6/2002 | Teagle | |
| 6,443,834 | B1 | 9/2002 | Berger | |
| 6,855,050 | B2 | 2/2005 | Gagnon et al. | |
| 6,945,054 | B1 | 9/2005 | Jebaraj | |
| 6,948,192 | B2 | 9/2005 | Hipponsteel | |
| 7,037,188 | B2 | 5/2006 | Schmid et al. | |
| 2004/0166795 | A1* | 8/2004 | Fuchs | E06B 5/14 454/195 |
| 2004/0211162 | A1 | 10/2004 | Henrikson | |
| 2004/0253918 | A1 | 12/2004 | Ezell et al. | |
| 2007/0218827 | A1 | 9/2007 | Baik | |
| 2008/0014859 | A1* | 1/2008 | Edmisten | F24F 13/084 454/290 |
| 2009/0078120 | A1 | 3/2009 | Kummer et al. | |
| 2013/0180700 | A1* | 7/2013 | Aycock | F24F 11/0001 165/248 |
| 2014/0053368 | A1* | 2/2014 | Gammack | A47L 9/1625 15/353 |
| 2014/0262132 | A1* | 9/2014 | Connell | B60H 1/00457 165/11.1 |
| 2015/0013245 | A1* | 1/2015 | Risser | F04D 17/105 52/173.1 |

FOREIGN PATENT DOCUMENTS

| | | | |
|---|---|---|---|
| KR | 20-0377288 | Y1 | 3/2005 |
| KR | 10-0877335 | B1 | 1/2009 |
| KR | 10-2010-0097528 | A | 9/2010 |

OTHER PUBLICATIONS

Airflow Characteristics at the Breathing Zone of a Seated Person: Interaction of the Free Convection Flow and an Assisting Locally Supplied Flow From Below for Personalized Ventilation Application by Zhecho Bolashikov et al. (2011).

Personalized ventilation: impact of airflow direction at the breathing zone on inhaled air quality by A. Melikov et al. and dated 2007.

* cited by examiner

AIR MIXING DEVICE

TECHNICAL FIELD

The present invention is generally directed to ventilation systems. More particularly, the present invention is directed to a ventilation system which provides a mixture of room air and outside air delivered directly to the vicinity of a user. Even more particularly, the present invention is directed to a personal ventilation system which is particularly usable in a sleeping environment or where the user is stationary for an extended period of time.

BACKGROUND OF THE INVENTION

Indoor Air Quality (IAQ) is a term which refers to air quality within and around a building as it relates to the comfort of building occupants. IAQ can be affected by gases (including carbon monoxide, radon, volatile organic compounds, etc.), particulates, mold or bacteria that can induce adverse health conditions. IAQ is a major health concern around the world and indoor air is usually much more polluted than outside air. Source control, filtration and the use of ventilation to dilute contaminants are the primary methods for improving air quality in most buildings.

ASHRAE standard 62.2 is a health and safety measure developed to enable dwellings to achieve acceptable levels of indoor air quality. This standard is achieved by ensuring that a certain minimum amount of outside air enters the building. ASHRAE standard 62.2 has been adopted to respond to concerns that reliance solely upon openable windows is inadequate to provide proper ventilation in low-rise residential buildings. The vast majority of low-rise buildings do not have a dedicated ducted air system with an outdoor air intake. Even in buildings that have a dedicated outdoor air intake system, it has been proven that the required ventilation often does not reach the occupants. Ceiling mounted vents often bypass the breathing zone. High-rise buildings often allow the ventilation air to escape into the hallways and often the system is not operating properly and there is generally no monitoring system to determine if it is operating properly.

The ventilation system arts are replete with various systems for air purification, air filtering, air ventilation to the outside and with similar air moving devices and systems. However, the present system is unique in that it is designed to introduce a controlled amount of exterior air directly into the vicinity of a user. Typically outside air is cooler and fresher than existing room air and the present invention takes advantage of this in a controlled way. Outside air is also advantageous in that it is apt to contain significantly fewer volatile organic compounds (VOCs) or other air contaminants. These compounds have been shown to have detrimental health effects. Furthermore, air purifiers located in a room have been shown to be highly ineffective for removing these contaminants.

The functions provided by the present invention are often carried out by users simply opening a window to various degrees. In the springtime and summer, windows may be opened to a fairly wide degree. In the winter, sleeping or stationary individuals seeking cooler, fresher air are limited to merely cracking open a window by a very slight amount. This is a form of uncontrolled ventilation. By the time the outside air reaches the occupants, it has often picked up contaminants in the room. It is additionally noted that rooms (especially sleeping quarters) occupied by two or more individuals often suffer the limitation that the temperature requirements of one individual do not match those of a second individual and the invention can be used to create a temperature gradient to match the needs of both occupants. In houses with multiple bedrooms and only one heating zone the occupants of the different bedrooms often have temperature requirements that vary. To meet these requirements, the thermostat (generally in a hallway) is set to meet the temperature of the bedroom occupant that desires the warmest temperature. In these circumstances, the present invention is usable in the other bedrooms to keep them cooler in accordance with the needs/desires of their occupants.

The present invention is also useful in circumstances in which the temperature level in a dwelling, such as an apartment with steam heat, is not controllable by its occupant(s). There are many circumstances in building design and operation when these apartments tend to be overheated. There are also circumstances where there is no temperature control accessible to the tenant. In these circumstances, it would be desirable for an occupant to have a supply of cool/fresh air delivered directly to his or her personal space or to lower the dwelling temperature to a desired level. In circumstances such as these, where the present invention is not available, there is a tendency for tenants to open an exterior window, which can cause uncontrolled temperature fluctuations and drafts and which wastes energy.

U.S. Pat. No. 2,010,809 issued in 1935 to Daniel L. Braine is relevant in that it teaches introducing exterior air into a room and mixing exterior air with room air in various proportions. It is noted that, while the inventor refers to his invention as an air conditioner, it does not appear to be an air conditioner in terms of the current vernacular. It is significant that this particular device is solely meant to be disposed within a window. There is no attempt to direct air directly into the personal space of a user. The specific teachings of Braine are that air is introduced into the general room environment without any attempt whatsoever to direct it to a specific location within the room nor to control the air delivered in a manner which is consistent with the comfort of a user. It is also relevant to note that this particular document is over 80 years old. Similar teachings are found in the patent to Wilson, discussed below. Furthermore, with respect to this patent: there is no automatic air mixing; there is no damper control or shut off; and there is no provision for pressure relief.

In terms of other ventilation systems with which the present invention may be compared, one such system is described in US patent application 2004/0211162 published on Oct. 24, 2004 in the name of Henrikson. This application describes a portable air filtration tool. This application describes a ventilation device which is designed to remove contaminated air from a room or building. It is described as an emergency ventilation system for removing airborne toxic materials. The system of Henriksen also considers the possibility of merely circulating existing room air through a filter for decontamination purposes. However, it is important to note that the patent application of Henriksen does not teach, disclose or suggest anything with respect to mixing exterior air and interior air. In fact, such operations would run counter to the objectives set forth in Henriksen. Henriksen is also oblivious to the concept of providing a controlled airstream into a user's personal space to provide temperature and ventilation requirements.

Another ventilation system is disclosed in U.S. Pat. No. 6,402,613 issued on Jun. 11, 2002 in the name of Teagle. This patent describes a portable environmental control system. His portable environmental control system is designed for evacuating particulate laden, toxic, and explosive gases from an interior space. The patent of Teagle is solely directed to the removal of air from an interior room environment. Those skilled in the ventilation arts would not contemplate the use of the apparatus in Teagle for the purpose of introducing exterior air into an interior environment.

In U.S. Pat. No. 6,014,949 issued to Ball on Jan. 18, 2000, there is apparently disclosed a system for preconditioning air intended to be directed into a doghouse. Again, this invention is directed to an apparatus which is designed to exhaust air from a human environment into a canine environment with the inclusion of screening which prevents flying insects from traversing the doctor worked into the human environment. It would appear that this invention is primarily directed to providing heat to a canine enclosure from heated air that is already present in the dog owner's abode. As with the inventions described above, this one also is intended for the extraction of air from a human occupied structure to the outside rather than the introduction of a controlled amount of air from the outside to an interior location.

One of the more common ventilation systems found within a home or the ones found for bathroom ventilation. An example of this is found in U.S. Pat. No. 6,443,834 issued to Berger on Sep. 3, 2002. As with the above documents, this patent is solely directed to situations in which it is desired to exhaust air from an interior room.

Of relevance also are certain documents that relate to room air-conditioning and cooling. In particular, U.S. Pat. No. 5,606,865 issued on Mar. 4, 1997 to Caron describes a portable air cooler. In this device, cool water from a sink faucet is directed through the device in order to cool interior device surfaces. A fan is provided to cause a flow of room air across cooled interior surfaces. It is of particular note that this device does not in any way either introduce exterior air into a room nor does it vent interior air out of a room. Furthermore, it does not provide a mixture of exterior and interior air directed to a specific location within a room. Its essential relevance lies only in its relative portability.

Of note also is U.S. Pat. No. 2,218,330 in the name of Oscar Eliason issued on Oct. 15, 1940. This patent appears to disclose a ventilation device which is designed for insertion into a window. In many ways this patent is similar to the above-mentioned patent to Braine. However, it differs in that it includes a heater element for heating exterior air. Furthermore, this patent is solely directed to providing ventilation to an entire room not to a localized region within the room. Like the above-mentioned patent to Eliason, it is noted that the patent to Braine is over 75 years old.

Issued U.S. Pat. No. 2,296,635 to Foehrenbach et al. might also be considered to be relevant to the invention claimed herein. It, too, is a relatively ancient patent, however, having been issued on Sep. 22, 1942. This is a device which is described as drawing exterior air into a room and for circulating air within a room. It is further relevant in that it appears to teach mixing outside air with interior air in various proportions. However, its operations are limited to an entire room. There is no teaching, disclosure or suggestion that it could provide treated air to an individual's personal space. In fact, its placement and design are contrary to such a purpose. Furthermore, with respect to this particular patent: it lacks portability; there is no shutoff damper; and there is no airstream which is directed into the vicinity of a user's personal space.

Attention is also directed to U.S. Pat. No. 6,855,050 issued on Feb. 15, 2005 in the name of Gagnon et al. This patent is deemed relevant in that it describes a damper system for the control of air flow in a ventilation system. However, its operation appears to be limited to existing, ducted ventilation systems for entire buildings or for entire rooms within a building.

Attention is next directed to the published international patent application of Hwang et al. This document bears a publication date of Oct. 17, 2011 and bears an international publication number of WO2011/132995 A2. This document appears to be relevant in that it describes a ventilation mechanism which includes a heat exchanger which is designed to heat incoming air to the same temperature as air that is being exhausted from a room. It is a window-mounted system which is designed for the exchange of air between an interior and exterior environment. It is directed to operation for an entire room and its structure and purpose are inconsistent with providing cooler air to the personal space surrounding a sleeping user.

U.S. Pat. No. 6,945,054 issued on Sep. 20, 2005 (filed on Jan. 2, 2002) to Jebaraj appears to disclose a self-contained air conditioning apparatus. The apparatus described in this patent is directed to an air-conditioning system intended to be used to condition the air in a structurally well-defined area surrounding a bed. There is a vent duct provided the side of a structure surrounding a bed area. Note that reference 12 is described as being a mattress. There is no connection to exterior air.

U.S. Pat. No. 5,080,005 issued on Jan. 14, 1992 (having been filed on Jan. 9, 1991) to Kolt appears to disclose a system of passive building vents which are designed for use in conjunction with a multistory building. The invention appears to rely upon what the inventor describes as a chimney effect present in multistory buildings. It is entirely passive and appears to be designed solely for the purpose of equalizing air pressure.

Chinese Patent No. CN201602434 U published on Oct. 13, 2010 based on an application filed on Mar. 21, 2010 appears to describe a ventilation system for use in a bedroom in which air laden with carbon dioxide from around a sleeping person is exhausted from the area of the person and is replaced with air from other parts of the dwelling such as hallways.

U.S. Pat. No. 5,702,296 issued Dec. 30, 1997 to Lars Grano appears to describe a portable ventilation system for sucking outside air into a room and for extracting air from that room. The system is designed for professional workers who are working in environments contaminated with dust, solvents, fungicides and the like. This patent teaches that the conduit carrying fresh air into a room completely surrounds a separate conduit which is required for conducting stale air from the room. In short, the teachings of grotto are such that and exhaust mechanism is required.

U.S. Pat. No. 1,788,556 issued Jan. 13, 1931 to Wood et al. appears to describe a ventilating device intended to be placed within a window frame. Air in the room is reconditioned by passage through a filter in the device. Air in the room is mixed with air from the outside. The patent teaches that an entire room is to be treated as a single entity in terms of ventilation. It has no personal, portable or local aspects. It is directed to an entire room as a whole. It has no shutoff damper or means of providing a controlled airstream into a user's personal space to provide temperature and ventilation requirements. It is also noted that this particular patent bears a filing date of Jun. 15, 1927. It is 88 years old.

Attention is also directed to U.S. Pat. No. 5,584,286 issued on Dec. 17, 1996 to John E. Kippax (based upon an application filed on Aug. 18, 1994). This patent is directed to a breathing apparatus which includes a mask designed to fit over the nose and mouth of a wearer together with an air conduit which is connected to a flat window mounting assembly which is designed for sealable placement within a window frame containing a slidable window. It is specifically designed to exclude air present in the room. The patent does appear to contemplate the presence of an air moving device, however, next year with internal room air seems to be specifically taught against.

The patent to Wilson was issued on May 18, 1982, was filed on Apr. 13, 1981 and bears U.S. Pat. No. 4,330,082. While this patent appears to disclose the mixing of interior and exterior air and exterior winter air in particular, there is nothing "personal" in its operation. It does not employ flexible conduits, is not mobile or portable. More particularly, it is not capable of providing a relatively slow flowing stream of filtered and cooler air to the immediate vicinity of a user.

Also considered is the patent to Hipponsteel, U.S. Pat. No. 6,948,192 issued on Sep. 27, 2005 based on an application having a filing date of Mar. 29, 2002. This is yet another patent that is directed to exhausting malodorous interior air. The air that is drawn into this device appears to be air that is already present in a room, such as a bathroom. While this patent generally deals with aspects of ventilation it does not teach the mixing of exterior and interior air.

The discussion above has been provided in order to make it abundantly clear that, over a period of many decades, many inventions in the ventilation arts have arisen without having addressed the particular problem solved herein. Moreover, the discussion above indicates that those working in the ventilation arts have failed to devise an apparatus for introducing a controlled amount of exterior air, particularly winter air, directly into the vicinity of the space of an individual, particularly that of a sleeping person.

All publications and patent applications mentioned in this specification are indicative of the level of skill of those skilled in the art to which this invention pertains. All publications and patent applications are herein incorporated by reference to the same extent as if each individual publication or patent application was specifically and individually indicated to be incorporated by reference.

From the above, it is therefore seen that there exists a need in the art to overcome the deficiencies and limitations described above and elsewhere herein. In particular, it is seen that the present invention is particularly useful in providing appropriately conditioned air directly to the vicinity of a user particularly during times of sleep.

SUMMARY OF THE INVENTION

The shortcomings of the prior art are overcome and additional advantages are provided by means of a device for mixing air sources, comprising: an enclosure having one air inlet opening for receiving outside air, a second air inlet opening for receiving inside air, and an outlet air opening for exhausting air from inside the enclosure; an air moving device for removing air from within the enclosure through the air outlet opening; a flexible conduit, exterior to the enclosure and attached to the first air inlet opening; and a barrier structure having an opening therein for receipt of the flexible conduit; the barrier structure provided is suitable for sealable placement in an exterior window. Alternatively, the flexible conduit may be inserted into the opening in an exterior wall. In this way, a controllable mixture of interior and exterior air is delivered to a location in the proximity of the enclosure.

The device is provided with a temperature sensor and/or a flow sensor controller which moderates the operation of the air moving device. The controller also operates to control one or more dampers so as to moderate the volume of air flow entering the enclosure from within the room and from the exterior. Flexible conduits allow the device to be mobile and portable so that it and/or its exhaust may be placed in close proximity to an end user such as one who is sleeping in bed or is sitting at a desk.

The present invention introduces a controlled amount of outside air directly into the personal space of an occupant to satisfy ventilation and temperature requirements.

It is a further object of the present invention to provide a stream of filtered air to a sleeping user.

Accordingly, it is an object of the present invention to provide a stream of air directly to the vicinity of a user.

It is another object of the present invention to provide a stream of air whose temperature is controllable.

It is yet another object of the present invention to provide a user with the ability to introduce a controlled amount of exterior air to a user's environment.

It is a still further object of the present invention to introduce exterior, cooler winter air into a room without significantly impacting room temperature, if so desired.

It is still another object of the present invention to reduce the amount of VOCs or other contaminants to which a person is exposed.

It is another object of the present invention to lower the temperature in an overheated apartment, room in a dwelling or other human occupied space.

Lastly, but not limited hereto, it is an even further object of the present invention to provide fresh cool air to one individual without significantly impacting another person in the same vicinity and to allow for a temperature gradient between that individual and another individual in close proximity (such as a couple in bed).

Additional features and advantages are realized through the techniques of the present invention. Other embodiments and aspects of the invention are described in detail herein and are considered a part of the claimed invention.

The recitation herein of desirable objects which are met by various embodiments of the present invention is not meant to imply or suggest that any or all of these objects are present as essential features, either individually or collectively, in the most general embodiment of the present invention or in any of its more specific embodiments.

BRIEF DESCRIPTION OF THE DRAWINGS

The subject matter which is regarded as the invention is particularly pointed out and distinctly claimed in the concluding portion of the specification. The invention, however, both as to organization and method of practice, together with the further objects and advantages thereof, may best be understood by reference to the following description taken in connection with the accompanying drawings in which:

DETAILED DESCRIPTION

Figure 1:
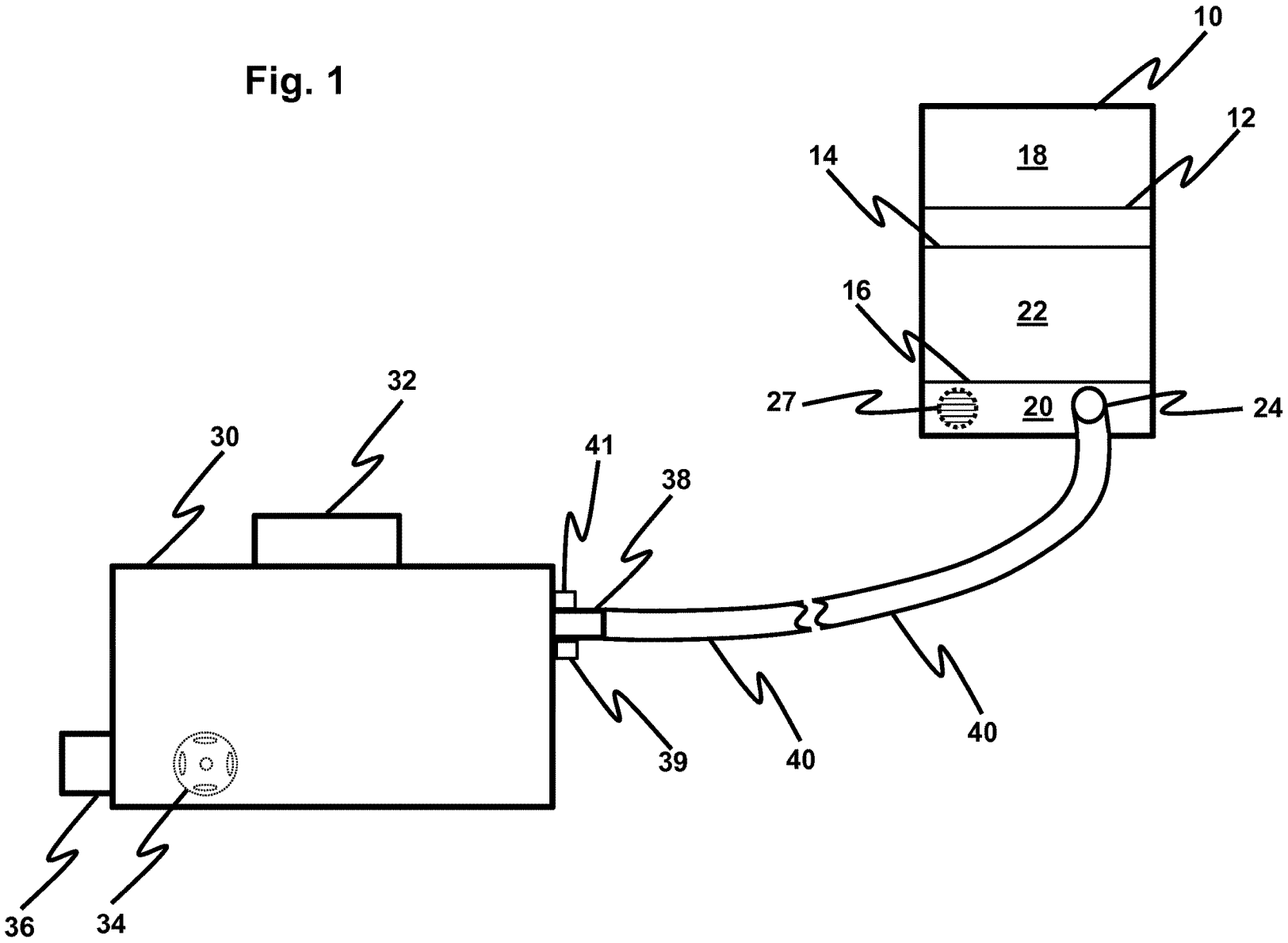
FIG. 1 is a schematic view illustrating the exterior of the device and its relationship to a standard double-hung window.

FIG. 1 provides an overall view of the structure and function of the present invention. In particular, it is seen that enclosure at 30 provides a containment system for receipt of air from two sources. Room air enters enclosure 30 through vent 32. It mixes with exterior air provided via flexible conduit 40 which attaches to enclosure 30 at coupling 38. Air is drawn into enclosure 30 from these two sources by means of an air moving device such as a fan driven by motor 34 shown in shadow view. In preferred embodiments of the present invention, the fan (or other air moving device) has a speed control. Air mixed in enclosure 30 is exhausted into the surrounding room through port 36. Port 36 may also be provided with a flexible conduit (not shown) for the purpose of a more focused distribution of air to the occupant. Enclosure 30 may also be provided with internal baffles (not shown) to promote air mixing. Port 36 may be connected to another air conducting conduit with an exhaust end nearer to the personal space of a user or enclosure 30 may include a port 36 having a grill or louvers therein for distribution of air to a user. The louvers may be adjustable.

While the air moving device of the present invention is described above as a fan driven by a motor, any convenient air moving device may be employed. In particular, for more silent operation, the air moving device may be provided in the form of an array of piezoelectric devices. When multiple occupants are involved, it is generally not the intention of the present invention to be operated in a manner in which high velocity air is directed at or in the vicinity of a user. The intention is to provide a relatively small flow of air to the vicinity of a user without that airflow having significant impact on adjacent persons. As a consequence in its typical use, the air moving device of the present invention does not require significant amounts of power.

It is also noted that, in some embodiments of the present invention a temperature sensor such as sensor 39 is employed. This sensor is intended to provide an indication of the temperature of outside air being supplied to enclosure 30. The closer that enclosure 30 is to the window (or wall opening) shown, the smaller the temperature difference between external air at the window and the temperature of air in conduit 40 when it reaches enclosure 30. Since it is convenient, from the perspective of making the present invention, position of temperature sensor 39 is preferably located as shown in FIG. 1. However, if placement in this location is problematic due to high room temperatures, conduit 40 may be provided with thermal insulation (not shown). Temperature sensors are also employable to measure discharge air temperature, ambient air temperature or both.

Flexible conduit 40 may comprise any suitable material including but not limited to plastics, rubber, corrugated metal or other various polymeric substances. Its primary characteristic is that the material be substantially impervious to the passage of air and that it be flexible. Flexibility of conduit 40 renders the device of the present invention portable and mobile in that it makes it possible to position enclosure 30 in close proximity to a user of the device. Conduit 40 may also be insulated to prevent condensation. Conduit 40 is easily connected to and detached from both enclosure 30 and window baffle 20.

As part of the device of the present invention, there is provided barrier 20 which is disposable within a double hung window whose components are more particularly described below. Barrier 20 comprises any convenient material which is substantially rigid and impermeable to air. The function of barrier 20 is to provide blockage to any air entering the room when the window is opened. Furthermore, barrier 20 functions to permit air to enter the room only through opening 24 in barrier 20. The height of barrier 20 is selected to be any convenient size. Likewise, the thickness of barrier 20 is likewise chosen for convenience given its purpose. In preferred embodiments of the present invention barrier 20 includes well-known accordion pleat structures that extend outward from its ends so as to adjustably weight fit width wise into any standard double hung window. For other window structures, barrier 20 is selected to provide a convenient fit for size and for providing opening 24. Barrier 20 also optionally includes overpressure/exhaust port 27. This port provides an (adjustable) exhaust mechanism for air within a room to the exterior when the interior pressure becomes excessive.

Though not part of the present invention, a brief description of the structures shown in window 10 are provided. In particular, in a standard double hung window, there are two panes of glass, here shown as upper pane 18 and lower pane 22. The bottom portion of pane 18 is shown as reference numeral 14. Likewise, lower pane 22, shown in a slightly raised position to accommodate barrier 20, includes upper edge 12 and lower edge 16.

Figure 2:
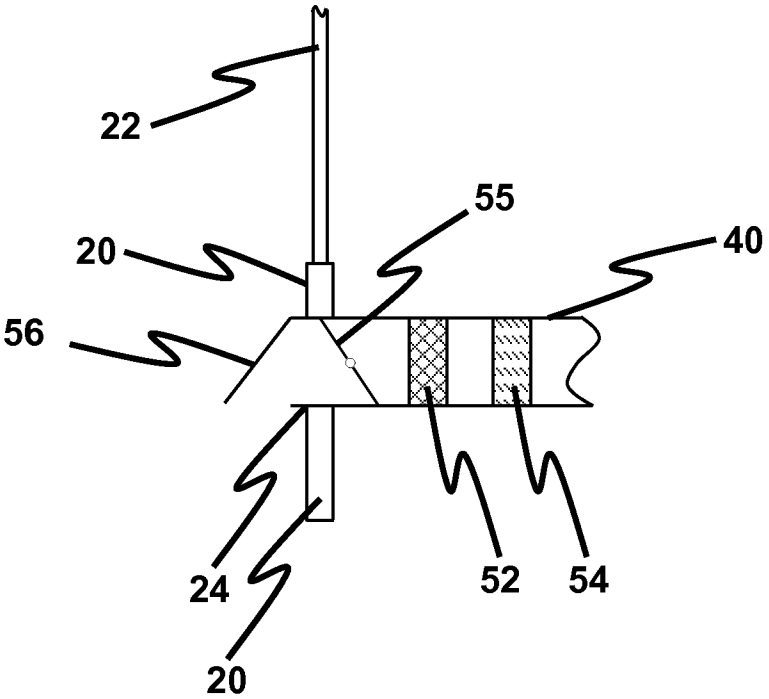
FIG. 2 is a cross-section of a portion of the device of the present invention, which sits in a standard, the double hung window.

FIG. 2 illustrates the portion of conduit 40 which extends through barrier 20. In particular, the location of lower glass pane 22 (and its associated framing structure—not shown). In particular, it is seen that conduit 40, in this location, is preferably provided with rain guard 56. Also included in this portion of conduit 40 are air filter 52 and optional heater 54. Air filter 52 and heater 54 are also optional both as to their presence and their location. Any additional air filtration is preferably positioned at or near port 36. A heater is useful in those situations in which the outside air is extremely cold yet one wishes to provide a relatively large volume of fresh air. A heater may be disposed at any convenient location in the flow of air through the invention; however, it is most effective in the flow of outside air and preferably at port 38. It is also possible to position air filter 52 adjacent to enclosure 30, either just inside of it or just outside of it.

Of particular importance in the present invention is damper 55. In preferred embodiments of the present invention damper 55, which controls admission of exterior air, comprises a weighted, pivoted element similar to a damper structure found in a standard furnace chimney. In this configuration, damper 55 is moved into an open position by means of negative air pressure in enclosure 30 produced by the air moving device. Finer control of damper 55 is had by implementing it in the form of a motor-controlled, pivoted plate. The present invention cycles on and off or modifies damper settings and/or heater and fan speed in response to sensor input and user settings. When the present invention has turned off in its cycling sequence due to ventilation and/or temperature requirements having been met, the room is effectively sealed from the outside air. If user requirements are met, damper 55 is closed and/or the air moving device is turned off or turned to a low speed setting. The present invention may also be operated in bypass mode. In bypass mode, outside air is shut off and air within the room is recirculated through enclosure 30 for purposes of heating and/or filtration.

Figure 3:
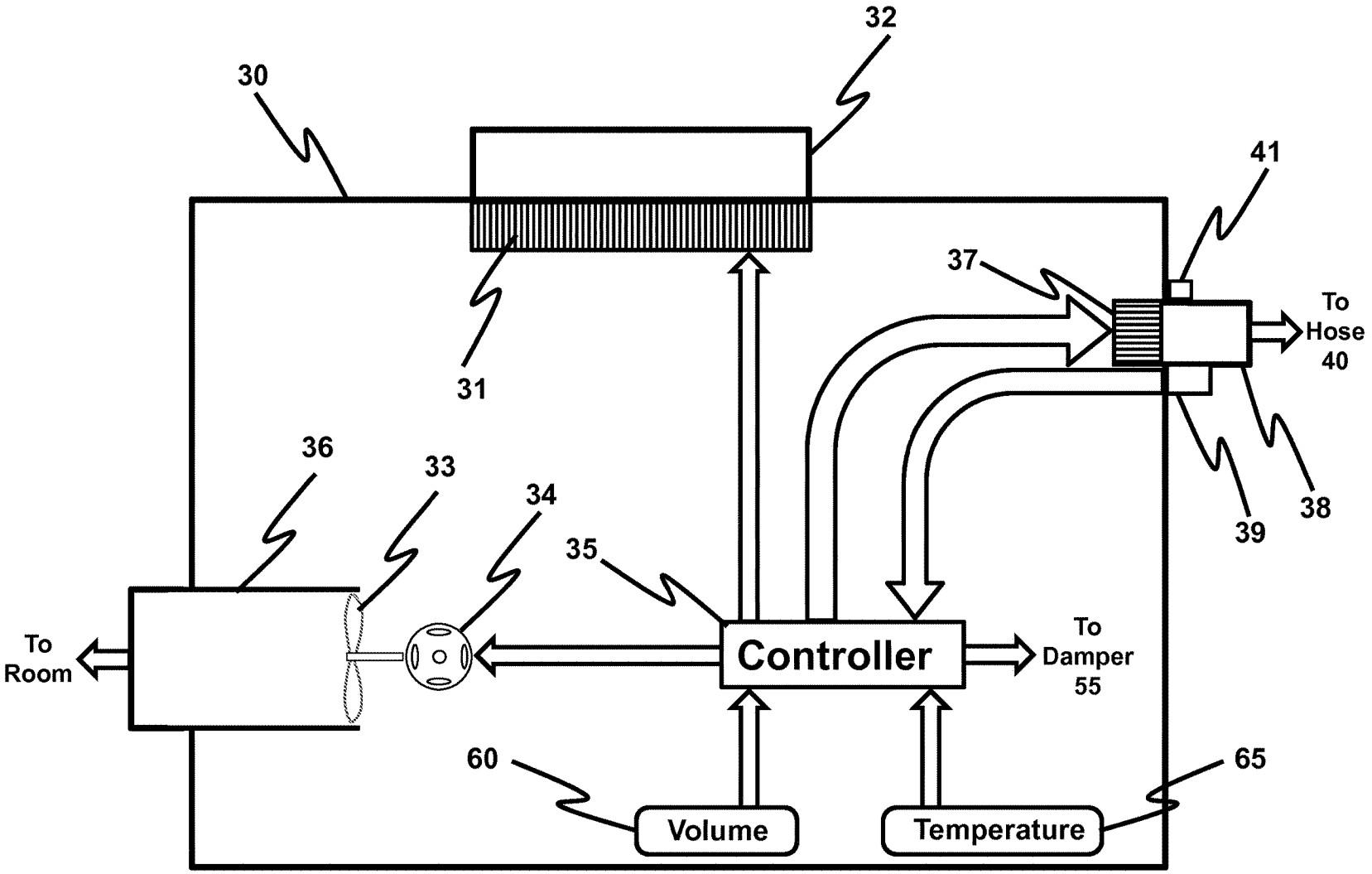
FIG. 3 is a schematic view illustrating the interior of the device of the present invention and particularly illustrating that portion which lies within the enclosure.

FIG. 3 is a schematic diagram illustrating the interior contents of enclosure 30. In particular, it is seen that motor 34 is employed to turn propeller or fan device 33 so as to move air from the interior of enclosure 30 to the room environment. Alternatively, exhaust outlet 36 is connected to a second flexible conduit (not shown) for those situations in which more precise control is desired in terms of the ultimate destination of processed air. This second flexible conduit may also be fitted with a grill for better directional or volume control. It is also noted that, while the air moving device shown in FIG. 3 comprises a motor and a fan, many other air moving devices are equally employable. It is the air moving device which creates a negative air pressure within enclosure 30 which in turn draws air from inlet 38 and from inlet 32. Inlet 32 provides air from the room environment in which enclosure 30 is employed. Inlet 38 provides air from the exterior environment through conduit 40 and window 10 (or wall opening). In this manner room air and external air are mixed together within enclosure 30. Additionally, room air inlet 32 is provided with flow limiting device 31; this device preferably comprises a series of angled vanes which is manually adjustable from outside the enclosure by a user. Flow limiting device 31 may also be controlled via controller 35. In this way the amount of room air input to the enclosure is controllable. Likewise, separate air flow control device 37 may be employed to control the amount of air supplied from conduit 40.

Damper 37 may be disposed within enclosure 30, placed in the window, or at the distal end of conduit 40. Damper 55 can act as the modulating damper either replacing damper 35 or operating in conjunction therewith.

The present invention may also be configured so that controller 35 is connected to a remote device such as a smartphone via a wireless connection. In such circumstances, an application running on the smartphone includes an interface with which the user can interact to control the device both in terms of temperature and flow rate.

Similarly, the present invention may also be configured to operate in conjunction with other wireless devices intended for environmental control functions. In particular, flow balancing within the space/dwelling is handled by communicating with an existing or a complementary newly installed exhaust fan or similar device. A dwelling may also be configured with a plurality of devices embodying the present invention in conjunction with other smart devices (exhaust fans, thermostats).

Enclosure 30 also includes controller 35. Based upon temperature settings inputted by a user via temperature knob 65 and also based upon flow volume settings specified by volume knob 60, controller 35 operates to determine the amount of room air, the amount of exterior air and the volume of air flowing through enclosure 30 and whether the fan is running (that is, if the device is on) and the speed of the fan. Additionally, controller 35 receives information from the above-described temperature sensor 39 and flow sensor 41. Controller 35 also operates to determine the position of damper 55.

It is also desirable to provide an exhaust port to the exterior. This port is preferably responsive to indications of higher pressure within the room in which the device is being operated. This feature provides a balancing effect so that air which is being introduced into the room from the exterior does not have to overcome positive pressure introduced into the room by the operation of the invention. The placement of such a port is illustrated by reference numeral 127 in FIG. 4. Alternatively, the exhaust port could be placed in a different window or ducted through a wall, typically an exterior wall.

Figure 4:
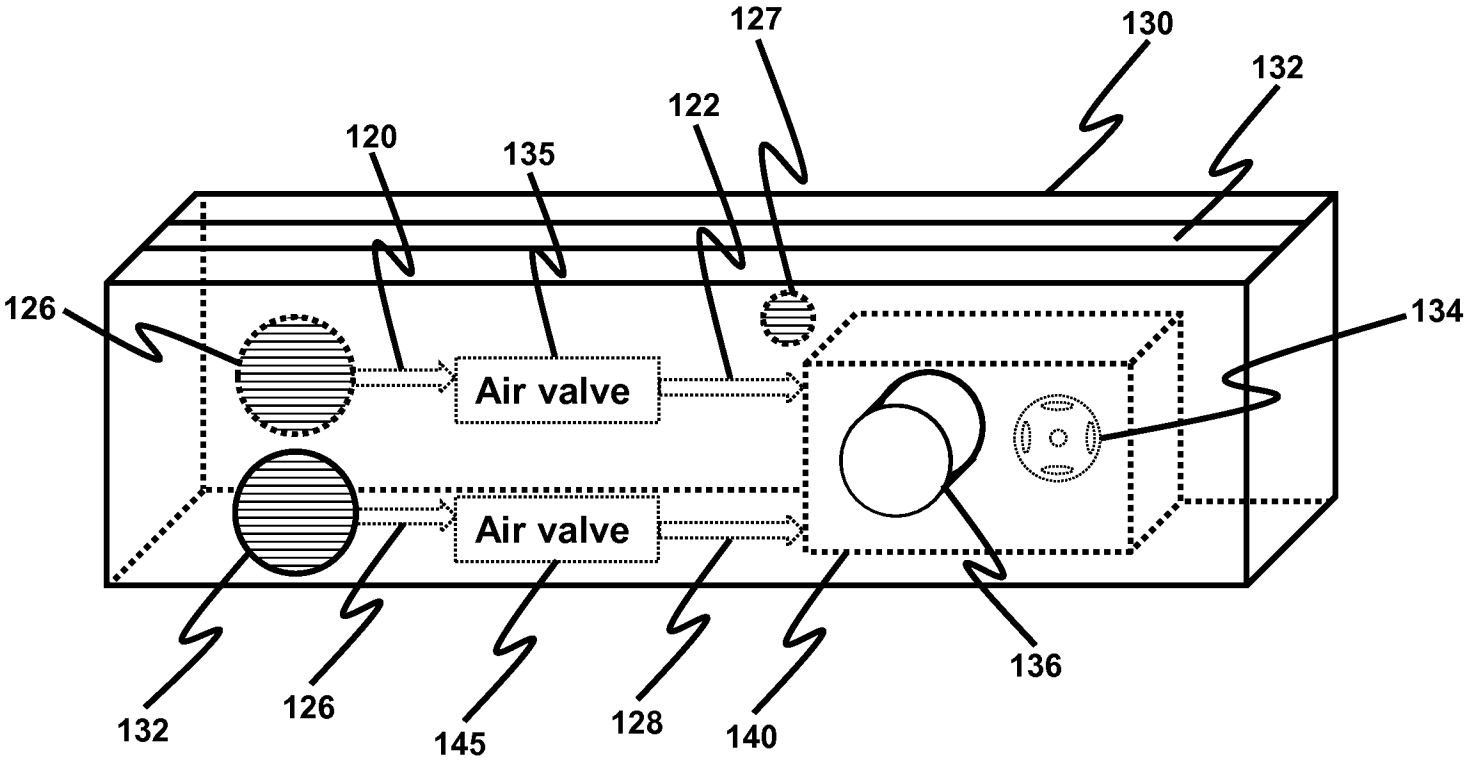
FIG. 4 is a schematic view illustrating an alternate embodiment of the present invention in which the outer enclosure is present in a form factor which is easily placeable within a window.

The present invention does not contemplate any specific length for air conduit 40 shown in FIG. 1. Conceptually, as this conduit's length is shortened, it is seen that the limiting case is one in which main enclosure 30 is present in a form factor which is designed to fit into an open window. Fans and air conditioning units already exist which have this form factor. Accordingly, there is an alternate embodiment of the present invention which is shown in FIG. 4.

The structure of this alternate embodiment includes exterior enclosure at 130 which is designed to fit into a standard double hung window. If one were to rotate the structure shown in FIG. 4 by 90°, it is seen that the resulting structure is one which is better designed to fit into a horizontal sliding window structure. However, the structure shown in FIG. 4 includes slot or groove 132 which is intended to meet with the lower frame of a double hung window.

Enclosure 130 includes port 126 (shown in phantom view) on the back side of the enclosure. This port is provided for the purpose of admitting exterior air. Likewise, enclosure 130 also includes port 132 which is provided for the purpose of admitting interior air. Interior conduits direct exterior air from port 126 two interior mixing enclosure 140. The flow in these conduits is controlled by air valve 135. These conduits are shown schematically by arrows 120 and 122. The relevant aspect is the existence of a controllable air flow path from port 126 to interior enclosure 140. Likewise, a similar controllable air flow path from port 132 to interior mixing enclosure 140 is also provided as illustrated by reference numerals 126, 128 and 145.

Interior enclosure 140 receives two streams of incoming air: one from the exterior and one from the interior of the room. Air is drawn into enclosure 140 by means of air moving device 134 which is illustrated schematically by the motor which drives it. While the air moving device is shown as being disposed within interior enclosure 140, one or more such devices may be disposed in either one of the conduits leading to interior enclosure 140; it may also be disposed outside of enclosure 140. It is, however, noted that air moving devices employed in the present invention are not necessarily ones that require the presence of an electrical motor. Piezoelectric moving devices may also be employed. It is within interior enclosure 140 that exterior and interior air is mixed in a desired ratio. Likewise, it is from interior enclosure 140 that air is directed into the room via outlet port 136. Outlet port 136 is provided with an air conduit which leads directly from the window unit shown to the vicinity of a user.

It is also to be observed that enclosures 130 and 140 in FIG. 4 are illustrated in a manner in which enclosure 140 is described above as being interior to enclosure 130. This is not necessarily the case in all embodiments. In particular, it is noted that enclosure 140 is mountable on the front of enclosure 130. The relevant relationship of these two enclosures is that they are not in flow communication with one another except as provided via conduits from ports 126 and 132.

The control mechanism illustrated in a FIG. 3 is also present in the device shown in FIG. 4. However, for drawing convenience, it is not specifically shown in FIG. 4. As used herein, the term "fan" refers to any air moving device.

Although the description above contains many specifics, these should not be construed as limiting the scope of the invention, but as merely providing illustrations of some of the presently preferred embodiments of this invention. Thus, the scope of this invention should be determined by the appended claims and their legal equivalents. Therefore, it will be appreciated that the scope of the present invention fully encompasses other embodiments which may become obvious to those skilled in the art, and that the scope of the present invention is accordingly to be limited by the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 USC § 112, sixth paragraph, unless the element is expressly recited using the phrase "means for."

While the invention has been described in detail herein in accordance with certain preferred embodiments thereof, many modifications and changes therein may be effected by those skilled in the art. Accordingly, it is intended by the appended claims to cover all such modifications and changes as fall within the spirit and scope of the invention.

What is claimed is:

1. A device for mixing air sources, said device comprising:

a portable enclosure having a first air inlet opening for receiving controlled amounts of outside air, a second inlet opening for receiving inside air, and an air outlet opening for exhausting a mixed volume of said outside air and said inside air from within said enclosure for direct delivery to an individual user's location;

an air moving device for moving air from within said enclosure through said air outlet opening, said air moving device adapted to provide a flow of air directly into said user's personal space at said individual user's location, said air moving device adapted to provide personal ventilation to a breathing zone of said user;

a flexible conduit, exterior to said enclosure, attached to said first air inlet opening; and a barrier structure having an opening therein for receipt of said flexible conduit, said barrier structure being suitable for sealable placement in an exterior window, whereby a mixture of interior and exterior air is producible and said user is providable with a localized supply of fresh air.

2. The device of claim 1 further including a damper to control the amount of air entering said enclosure from said first air inlet opening.

3. The device of claim 2 in which said damper comprises a pivotable plate.

4. The device of claim 3 in which said damper is disposed at said window.

5. The device of claim 3 in which said damper is disposed within said enclosure.

6. The device of claim 1 further including a temperature sensor and a controller which together adjust the operation of said air moving device based on user settings.

7. The device of claim 1 further including a moveable damper and a controller which together adjust the flow of air upon based on user settings.

8. The device of claim 1 further including a flow sensor, a controller and a moveable damper which is adjusted based on user settings.

9. The device of claim 6 in which said temperature sensor is disposed adjacent to said enclosure.

10. The device of claim 6 in which said temperature sensor is disposed inside said enclosure.

11. The device of claim 6 in which said temperature sensor is disposed adjacent to said barrier structure.

12. The device of claim 1 in which said flexible conduit includes an air filter.

13. The device of claim 1 in which said flexible conduit includes a heater.

14. The device of claim 1 in which said flexible conduit is thermally insulated.

15. The device of claim 1 in which said enclosure includes an air filter within said enclosure at said air outlet opening.

16. The device of claim 1 in which said enclosure includes a heater disposed within said enclosure in a flow path between said first air inlet opening and said air outlet opening.

17. The device of claim 1 further including a second flexible conduit in fluid communication with said air outlet opening.

18. The device of claim 17 in which the lengths of said flexible conduits are selected to position said enclosure near closer to said window.

19. The device of claim 1 further including an overpressure valve positioned so as to exteriorly exhaust room air.

20. The device of claim 19 in which said overpressure valve is positioned in said barrier structure.

21. The device of claim 19 in which said overpressure valve is positioned in an exterior wall.

22. A device for mixing air sources, said device comprising:

a portable enclosure having a first air inlet opening for receiving controlled amounts of outside air, a second inlet opening for receiving inside air, and an air outlet opening for exhausting a mixed volume of said outside air and said inside air from within said enclosure for direct delivery to an individual user's location;

an air moving device for moving air from within said enclosure through said air outlet opening, said air moving device adapted to provide a flow of air directly into said user's personal space at said individual user's location, said air moving device adapted to provide personal ventilation;

a flexible conduit, exterior to said enclosure, attached to said first air inlet opening and adapted for connection to an opening in an exterior wall, whereby a mixture of interior and exterior air is producible and said user is providable with a localized supply of fresh air.

23. The device of claim 22 in which said individual user's location is the breathing zone of said user.

24. A device for mixing air sources, said device comprising:

a portable enclosure having a first air inlet opening for receiving controlled amounts of outside air, a second inlet opening for receiving inside air, and an air outlet opening for exhausting a mixed volume of said outside air and said inside air from within said enclosure for direct delivery to an individual user's breathing zone;

an air moving device for moving air from within said enclosure through said air outlet opening, said air moving device adapted to provide a flow of air directly into said user's personal space at said individual user's location, said air moving device adapted to provide personal ventilation;

a flexible conduit, exterior to said enclosure, attached to said first air inlet opening; and a barrier structure having an opening therein for receipt of said flexible conduit, said barrier structure being suitable for sealable placement in an exterior window, whereby a mixture of interior and exterior air is producible and said user is providable with a localized supply of fresh air.

* * * * *